US005675911A

United States Patent [19]

Moser

[11] Patent Number: 5,675,911

[45] Date of Patent: Oct. 14, 1997

[54] ARTICLE AND METHOD FOR TREATING FABRICS IN A CLOTHES DRYER

[76] Inventor: Scott A. Moser, 3038 Hamilton Road, R.R. #2, Dorchester, Ontario, Canada, N0L 1GO

[21] Appl. No.: 308,392

[22] Filed: Sep. 19, 1994

[51] Int. Cl.[6] ..... F26B 7/00

[52] U.S. Cl. ..... 34/389; 34/60; 34/597

[58] Field of Search ..... 34/60, 589, 390, 34/597

[56] References Cited

U.S. PATENT DOCUMENTS

| | | | |
|---|---|---|---|
| 3,650,816 | 3/1972 | Rudy et al. | 34/389 |
| 3,870,145 | 3/1975 | Mizuno . | |
| 3,944,694 | 3/1976 | McQueary . | |
| 4,004,685 | 1/1977 | Mizuno et al. . | |
| 4,014,105 | 3/1977 | Furgel et al. | 34/60 |
| 4,073,996 | 2/1978 | Bedenk et al. . | |
| 4,114,284 | 9/1978 | Weber et al. | 34/390 |
| 4,167,594 | 9/1979 | Schwadtke et al. | 34/60 |
| 4,223,029 | 9/1980 | Mahler et al. . | |
| 4,260,054 | 4/1981 | Bory et al. | 206/0.5 |
| 4,532,722 | 8/1985 | Sax | 34/60 |
| 4,572,051 | 2/1986 | Laskin . | |
| 4,733,774 | 3/1988 | Ping, III et al. | 206/0.5 |
| 4,839,076 | 6/1989 | Willman et al. . | |
| 4,882,917 | 11/1989 | Mizusawa et al. | 68/17 A |
| 5,040,311 | 8/1991 | Roy . | |
| 5,176,275 | 1/1993 | Bowie | 220/201 |

*Primary Examiner*—F. Daniel Lopez

*Attorney, Agent, or Firm*—Reising, Ethington, Barnard & Perry

[57] ABSTRACT

An article and method are disclosed for controlling the build-up of static electricity within a clothes dryer by adding the article to the dryer along with a load of fabrics to be dried. The article comprises a bladder formed from a waterproof, moisture-permeable material, such as expanded polytetrafluoroethylene. Within the bladder is a sponge or other water-absorbent material. The article releases sufficient moisture during tumbling of the article with the fabrics to prevent the build-up of static electricity on the fabrics. To avoid loss of moisture from the bladder when it is not in use and during the early portions of the dryer cycle, the waterproof material utilized can be one that is moisture-impermeable at room temperature, but that becomes moisture-permeable at the elevated temperatures that exist within the dryer during the later portions of the dryer cycle. The article includes a fill spout for adding water and other fabric conditioning agents to the bladder. Fabric conditioning agents carried by the bladder can also be microencapsulated to provide a timed release of the agents so that fabric conditioning can be provided continuously and over a large number of dryer loads.

14 Claims, 2 Drawing Sheets

ARTICLE AND METHOD FOR TREATING FABRICS IN A CLOTHES DRYER

FIELD OF THE INVENTION

This invention relates in general to articles and methods for treating fabrics in an automatic clothes dryer and, more particularly, to an article placed within the dryer for fabric conditioning and control of static electricity.

BACKGROUND OF THE INVENTION

As is now well known, fabrics can be treated within a clothes dryer using an article containing conditioning agents for such purposes as fabric softening, scenting, and preventing build-up of static electricity. The conditioning agents can be incorporated into the article in various ways. For example, the conditioning agents can be: provided on or throughout a flexible substrate, as in U.S. Pat. No. 3,944,694 issued Mar. 16, 1976 to A. R. McQueary; impregnated or absorbed into a sponge or other open-cell foam material, as in U.S. Pat. No. 3,870,145 issued Mar. 11, 1975 to W. G. Mizuno, U.S. Pat. No. 4,073,996 issued Feb. 14, 1978 to W. T. Bedenk et al., and U.S. Pat. No. 5,040,311 issued Aug. 20, 1991 to J. Roy; or contained within a permeable or rupturable pouch, as in U.S. Pat. No. 4,004,685 issued Jan. 25, 1977 to W. G. Mizuno et al., U.S. Pat. No. 4,223,029 issued Sep. 16, 1980 to D. G. Mahler et al., and U.S. Pat. No. 4,839,076 issued Jun. 13, 1989 to K. W. Willman et al.

Triboelectric build-up of static electricity within a clothes dryer occurs near the end of the drying cycle, when the moisture contained in the tumbling fabrics has been substantially removed. Earlier in the drying cycle, this moisture permits conduction of electric charge from the fabrics so that static electricity is substantially nonexistent. In the articles disclosed in the above-noted patents, control of static electricity is achieved using one or more various chemical agents that are transferred from the article to the fabrics tumbling within the dryer. These anti-static agents are incorporated into the article in one or more of the various ways mentioned above. Some of these schemes are designed for a single application. See, for example, the above-noted patent to McQueary. Others permit the article to be used along with more than one dryer load. For example, in the above-noted patent to Mizuno, anti-static agents can be impregnated into a sponge in a heat softenable form so that heat from the dryer causes softening and subsequent transference of some of the conditioning agent onto the fabrics present in the dryer. However, none of these anti-static articles are designed to have the anti-static agent replenished for continued use of the article. Thus, even the re-usable articles have a somewhat limited useful life.

SUMMARY OF THE INVENTION

The present invention provides an article and method for controlling the build-up of static electricity within a clothes dryer by utilizing a liquid impervious, moisture-permeable bladder that contains a volume of water and that, when heated within the dryer, permits moisture to permeate the bladder and moisten its outer layer to an extent sufficient to discharge static electricity from fabrics coming into contact with the moistened bladder. Thus, control of static electricity is achieved without the use of chemical anti-static agents, as are typically utilized by the prior art. If desired, chemical anti-static agents can be utilized in lieu of or in addition to the use of water to control build-up of static electricity. The bladder can be filled with a water-absorbing material, such as an open-cell foam to help disperse the water evenly throughout the bladder. Additionally, the bladder can contain a plurality of airflow vents that prevent the bladder from obstructing the dryer exhaust outlet.

In accordance with another feature of the present invention, a waterproof, moisture-permeable material is used that has a moisture vapor transmission rate that increases with increasing temperature so that more moisture is delivered by the bladder at the higher temperatures existing near the end of a dryer cycle, when build-up of static electricity begins. The material can be selected in accordance with typical dryer temperatures so that significant amounts of moisture are not released until the later portions of the dryer cycle. Thus, moisture is released primarily during that portion of the dryer cycle in which it is needed. Expanded polytetrafluoroethylene (ePTFE) can be used to provide this temperature dependent moisture vapor transmission rate.

In accordance with another aspect of the invention, the bladder contains a closeable fill spout that permits water or other liquid to be periodically added to the bladder, thereby enabling use of the bladder with hundreds of dryer loads.

In accordance with yet another aspect of the present invention, the bladder could provide other conditioning agents for such purposes as fabric softening, scenting, wrinkle control, stain treatment, mildew resistance, moth resistance, and others. One or more of these agents could be provided by the bladder in any of a variety of ways; for example, by being placed within the bladder, incorporated into the bladder, or incorporated onto the outer layer of the bladder. The agents could be provided in any of the various known forms, including heat softenable compositions impregnated into the open-cell foam or otherwise located within the bladder. Microencapsulation can be used to provide a timed release of the conditioning agent(s) so that the agent(s) can be dispensed from the bladder over a large number of dryer loads.

BRIEF DESCRIPTION OF THE DRAWINGS

A preferred exemplary embodiment of the present invention will hereinafter be described in conjunction with the appended drawings, wherein like designations denote like elements, and.

DESCRIPTION OF THE PREFERRED EMBODIMENT

Figure 1:
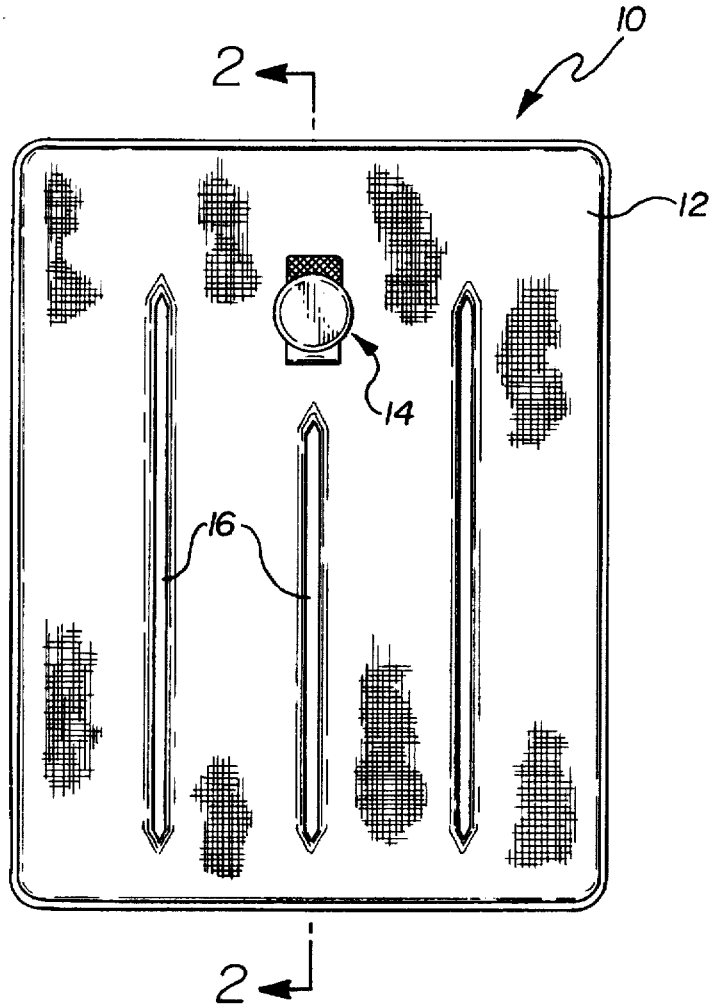
FIG. 1 is a front view of a preferred embodiment of the anti-static dryer article of the present invention.

Referring to FIG. 1, an anti-static dryer article embodying the present invention is shown and is designated generally at 10. Article 10 comprises a bladder 12 having a fill spot 14 and airflow vents 16. Fill spout 14 is used to fill bladder 12 with water and, if desired, other fabric conditioning agents, as will be described below. Airflow vents 16 permit direct airflow through article 10 without communication with the interior of bladder 12 so that article 10 will not significantly obstruct the exhausting of air from a dryer in which article 10 is used. As will be described below, bladder 12 is formed from a waterproof, moisture-permeable material. Control of the build-up of static electricity on fabrics tumbling within a dryer is achieved in general and in accordance with the present invention by placing a quantity a water within bladder 12, placing bladder 12 into the clothes dryer along with other fabrics to be dried, and operating the dryer in the usual manner to dry the fabrics. During the drying cycle, water vapor within bladder 12 will permeate bladder 12 and moisten its outer layer resulting in the surface of bladder 12 becoming electrically conductive. Thus, bladder 12 will discharge static electricity built-up on the fabrics with which it comes into contact, yet will not leave the fabrics feeling wet or damp.

It will be appreciated that the term "water", as used in connection with the present invention, does not refer to distilled water, but rather to electrically conductive water, such as tap water obtained through a standard household water faucet. Although water is preferred, other anti-static liquids that, as a vapor, will permeate bladder 12 can be used. Such anti-static liquids can include electrically conductive liquids other than water, or anti-static agents dissolved in water or some other solvent. Alternatively, an agent can be incorporated onto, into, or within bladder 12 that, together with an electrically non-conductive liquid within bladder 12, causes outer layer 18 to become electrically conductive. This could be accomplished using, for example, distilled water that permeates intermediate layer 20 and combines with an agent held by outer layer 18 to create an ionic solution in outer layer 18.

Figure 2:
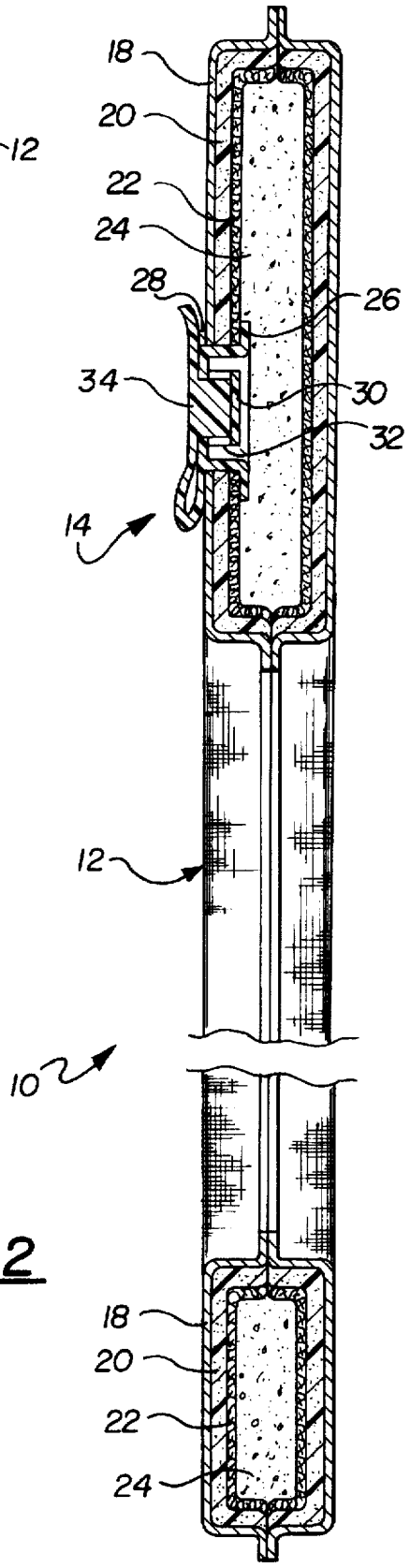
FIG. 2 is a cross-sectional view taken along the 2—2 line of FIG. 1.

Referring now also to FIG. 2, article 10 will be described in greater detail. Bladder 12 is formed from three layers, an outer layer 18, an intermediate layer 20, and an inner layer 22. It includes an open-cell foam 24 that fills the volume within bladder 12. Foam 24 can be a reticulated foam or other water-absorbing material, such as is used for making common household sponges. Outer layer 18 and inner layer 22 can both be fluid-permeable; that is, permeable to both gases and liquids. Intermediate layer 20 is permeable to gases, including water vapor, but not to liquids. Thus, bladder 12 can hold a volume of water and will only loose that water through vaporization of the water and subsequent permeation through the wall of bladder 12. Additional moisture-permeable layers can be included, as desired. Intermediate layer 20 can be an expanded polytetrafluoroethylene (ePTFE), such as described in U.S. Pat. No. 3,953,566 issued Apr. 27, 1976 to R. W. Gore, U.S. Pat. No. 4,194,041 issued Mar. 18, 1980 to R. W. Gore et al., and U.S. Pat. No. 5,026,513 issued Jun. 25, 1991 to W. D. House et al., the complete disclosures of which are hereby incorporated by reference. As is known, such materials are commercially available and are sold under the trademark Gore-tex by W. L. Gore & Associates, Inc. of Elkton, Md.

As is also known, such materials are commercially available that behave, in use with this invention, as though they are substantially moisture-impermeable at lower temperatures and substantially moisture-permeable at greater temperatures. Moreover, these materials can be manufactured to have a certain moisture vapor transmission rate at a certain temperature. For example, materials are commercially available that are moisture-permeable at room temperature (24° C.), such as are used in waterproof, breathable clothing, and materials are also commercially available that are substantially moisture-impermeable at 24° C., but that become moisture-permeable (while remaining waterproof) at a temperature above 24° C. These materials are also available from W.L. Gore & Associates, Inc. The advantage of these types of waterproof, moisture-permeable materials is that the particular material utilized for layer 20 can be preselected in accordance with typical dryer temperatures to provide a bladder that releases moisture primarily near the end of the dryer cycle, when it is most needed.

Outer layer 18 is a layer of blended materials, such as cotton, nylon, rayon, and/or other materials capable of absorbing or wicking enough moisture from intermediate layer 20 to permit conduction of electric charge through or along the surface of layer 18. Outer layer 18 also protects intermediate layer 20 from wear due to such things as friction with other fabrics. Preferably, layer 18 is made from a material that permits conduction of charge over its surface even in the absence of surface moisture. Inner layer 22 is a woven interface between intermediate layer 20 and foam 24. It comprises an absorbent cloth or other material that permits wicking of the water or other liquid within bladder 12 so that substantially all of the surface of intermediate layer 20 is in contact with moisture, even if the volume of liquid is concentrated at another location of bladder 12 due to gravity, centrifugal forces, or otherwise. Hydrophilic materials, as defined in the above-noted U.S. Pat. No. 4,194,041, can be used for inner layer 22. Intermediate layer 20 can be adhesively bonded to either layer 18 or 22, or both, using a moisture-permeable adhesive. Techniques and adhesives for such bonding are described in U.S. Pat. No. 4,925,732 issued May 15, 1990 to K. R. Driskill et al., the disclosure of which is hereby incorporated by reference. Intermediate layer 20 can be attached to layers 18 or 22 or both in other ways, such as are described in the above-noted U.S. Pat. No. 4,194,041.

Bladder 12 can be formed from opposed sections of layers 18, 20, and 22 that are die-cut either individually or, if any of the layers are to be bonded, after a pre-formed laminate is made from those layers. Foam 24 can also be die cut and placed between the opposed sections. Then, layer 20 and either layer 18, 22, or both are sealed about their periphery and at airflow vents 16 to provide a waterproof enclosure. These seams can be formed in any suitable manner using conventional techniques, such as heat or ultrasonic welding, gluing, or sewing. It will of course be appreciated that any other suitable method can be used to manufacture bladder 12 using intermediate layer 20 and foam 24.

Fill spout 14 is used to permit re-filling of bladder 12 after a substantial amount of water has permeated out through the walls of bladder 12, as will occur after repeated uses of article 10. Fill spout 14 can be attached to bladder 12 using known techniques. It can include an inner annular flange 26 and an outer annular flange 28 that capture layers 18, 20, and 22 therebetween. Fill spout 14 can include a recessed protective insert 30 having apertures 32 in its sidewalls to prevent the introduction into bladder 12 of materials other than fluids. A cap 34 fits into insert 30 to prevent escape of fluid through fill spout 14. Fill spout 14, including insert 30 and cap 34 can be formed as a unitary structure. Preferably, cap 34 is formed from a relatively soft plastic to minimize the noise made by cap 34 when contacting the dryer's drum during tumbling of article 10 within the dryer. Fill spout 14 can be attached to bladder 12 in a location, such as that shown, so as to help prevent overfilling of bladder 12 that could result in pressure being generated within bladder 12 when it is heated within the dryer. It is expected that by re-filling bladder 12 when needed, article 10 could be used with up to three hundred or more dryer loads.

Figure 3:
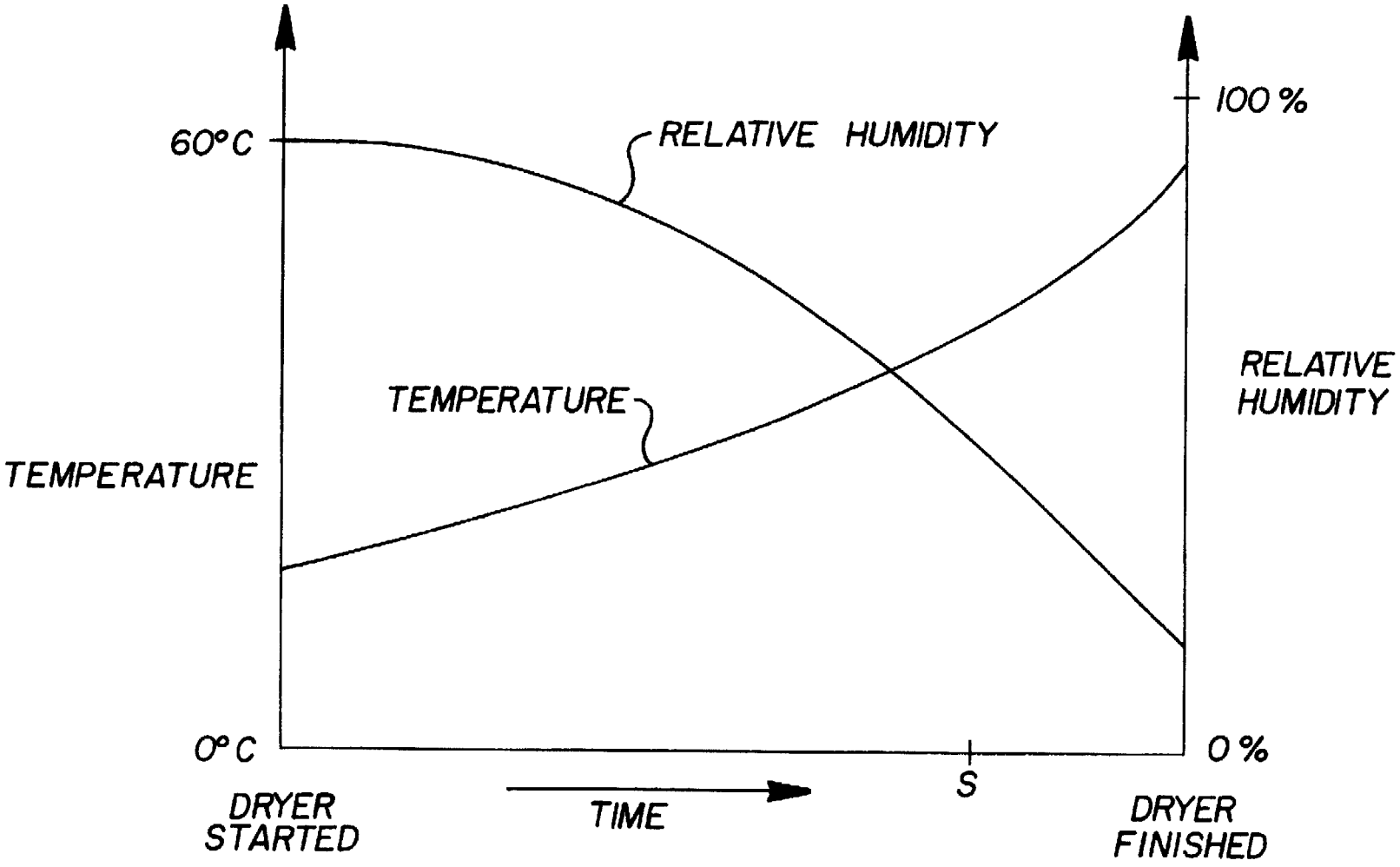
FIG. 3 is a graph showing the relationship between temperature and relative humidity in a dryer for a typical dryer load and dryer cycle.

Referring now to FIG. 3, the relationship between temperature and relative humidity within a dryer is shown for a typical dryer load and dryer cycle time. As this graph indicates, at the beginning of the dryer cycle, the temperature is relatively low (e.g., 20° C.) and the relative humidity is high (due to the large amounts of water contained in the fabrics). As the dryer cycle progresses, the temperature gradually increases and the relative humidity falls, as the water contained in the fabrics evaporates and is removed by exhausting air from the dryer. Triboelectric generation of static electricity on the clothes begins as the relative humidity falls below fifty to sixty percent. This is indicated at "S" along the time axis. Thereafter, the build-up of static electricity increases as more and more humidity is removed from within the dryer.

It will be noticed from the graph of FIG. 3 that, during the part of the dryer cycle in which triboelectric charging is present, the temperature is greater than at the earlier portions of the dryer cycle. The present invention can take advantage of the existence of this increase in temperature by utilizing a liquid-impervious, moisture-permeable material that is substantially moisture-impermeable at 24° C. and the lower temperatures encountered during the earlier portions of the dryer cycle, but that is substantially moisture-permeable at the higher temperatures encountered during the later portions of the dryer cycle. In this way, moisture is lost by bladder 12 only when needed to control the build-up of static electricity and not during periods of non-use or during the earlier portions of the dryer cycle when additional moisture is neither needed nor desirable. Preferably, the temperature above which layer 20 provides sufficient moisture to layer 18 to control static electricity is within the range of 36° C. to 60° C., with layer 20 having a pore size of at least 0.02 microns at temperatures above 36° C. As mentioned above, such materials are commercially available. The particular temperature at which layer 20 begins providing sufficient moisture will of course depend upon such factors as the size of article 10 and the temperatures generated by the dryer with which article 10 is used. Preferably, this temperature is selected so that article 10 can be advantageously used with any of a large number of different household dryers, including dryers that provide automatic control by switching off when the temperature within the dryer exceeds about 57°–60° C.

In addition to control of the build-up of static electricity, article 10 can be used to provide other fabric conditioning agents. These agents can be added into bladder 12 via fill spout 14 or incorporated in any of the various known ways mentioned above and described in the above-noted patents. Optionally, these agents can be incorporated into article 10 by microencapsulation of the agents within water soluble or heat softenable spheres. The spheres could be impregnated into foam 24 or otherwise provided on or within bladder 12. Then, heat or water within the dryer would dissolve the outer coating and release the fabric conditioning agent which, assuming proper relative sizes of the conditioning agent and pores of layer 20, would then permeate bladder 12 and transfer onto the fabrics within the dryer. Further, the thicknesses of the coatings or the composition of the coatings could be varied so that all of the fabric conditioning agent is not released during the same load. This would permit fabric conditioning agents to be provided by article 10 without them having to be replenished each time the water within bladder 12 was replenished. Suitable techniques for microencapsulation are well known. If one or more fabric conditioning agents are used, then arrangements such as are disclosed in the above-noted U.S. Pat. No. 4,194,041 can be used to account for changes in the permeation of water through layer 20 due to changes in surface tension of the water. Microencapsulation can also be used to release a chemical after a predetermined amount of time (e.g., two years) that reacts with a coating on bladder 12 or, preferably, the inside of cap 34, to produce a color change or other indication that replacement of article 10 is needed.

It will thus be apparent that there has been provided in accordance with the present invention an article and method for controlling static electricity within a dryer which achieves the aims and advantages specified herein. It will of course be understood that the foregoing description is of a preferred exemplary embodiment of the invention and that the invention is not limited to the specific embodiment shown. Various changes and modifications will become apparent to those skilled in the art and all such variations and modifications are intended to come within the spirit and scope of the appended claims.

What is claimed is:

1. An article for controlling build-up of static electricity and for conditioning fabrics within a clothes dryer, comprising:

a bladder defining a chamber adapted to hold a volume of water, said bladder comprising a moisture-permeable, waterproof material;

a closeable fill spout on said bladder having an opening that permits fluidic communication with said chamber; and a water-absorbing material contained within said bladder;

a fabric conditioning agent in the form of a plurality of quantities of said conditioning agent, each of said quantities being micro-encapsulated by a time release coating and being impregnated into said water-absorbing material; whereby, when said bladder is filled with water and inserted into a clothes dryer the conditioning agent of at least some of said quantities is released in the clothes dryer and heat within the clothes dryer produces water vapor within said bladder and permits the water vapor to permeate said material, thereby decreasing the amount of static electricity within the clothes dryer.

2. The article of claim 1, wherein certain ones of said coatings are adapted to dissolve and release a first portion of said conditioning agent after a first amount of time and others of said coatings are adapted to dissolve and release a second portion of said conditioning agent after a second amount of time that is different than said first amount of time.

3. The article of claim 1 wherein said time release coating is a water soluble coating.

4. The article of claim 1 wherein said time release coating is a heat dissolvable coating.

5. An anti-static article for controlling build-up of static electricity within a clothes dryer, comprising:

a bladder defining a chamber adapted to hold a volume of water, said bladder comprising a moisture-permeable, waterproof material;

a closeable fill spout on said bladder having an opening that permits fluidic communication with said chamber; and a first water-absorbing material contained within said bladder;

a second water absorbing material comprising an absorbent, woven layer between said waterproof material and said first water-absorbing material; whereby, when said bladder is filled with water and inserted into a clothes dryer water is absorbed by said first water-absorbing material and heat within the clothes dryer produces water vapor within said bladder and permits the water vapor to permeate said waterproof material, thereby decreasing the amount of static electricity within the clothes dryer.

6. The article of claim 5 wherein;

said closeable fill spout includes a lid, and means for producing an indication on said lid that the article should be replaced.

7. The article of claim 6 wherein said means is time responsive means.

8. The article of claim 7 wherein said time responsive means is a micro-encapsulated chemical for producing said indication.

9. The article of claim 5 wherein said second water absorbing material is electrically conductive over the surface of said layer.

10. An anti-static article for controlling build-up of static electricity within a clothes dryer, comprising:

a bladder defining a chamber adapted to hold a volume of water, said bladder comprising a moisture-permeable, waterproof material;

a closeable fill spout on said bladder having an opening that permits fluidic communication with said chamber; and a water-absorbing material contained within said bladder;

an outer covering over said waterproof material comprising a blend of cotton and synthetic fiber and being capable of holding moisture that has permeated through said waterproof material;

whereby, when said bladder is filled with water and inserted into a clothes dryer, heat within the clothes dryer produces water vapor within said bladder and permits the water vapor to permeate said material, thereby decreasing the amount of static electricity within the clothes dryer.

11. An anti-static article for controlling build-up of static electricity within a clothes dryer, comprising:

a bladder defining a chamber adapted to hold a volume of water, said bladder comprising a moisture-permeable, waterproof material;

a closeable fill spout on said bladder having an opening that permits fluidic communication with the chamber of said bladder; and a water-absorbing material contained within said bladder;

whereby, when said bladder is filled with water and inserted into a clothes dryer, heat within the clothes dryer produces water vapor within said bladder and permits the water vapor to permeate said waterproof material, thereby decreasing the amount of static electricity within the clothes dryer, and wherein said bladder has a pair of spaced apart oppositely disposed walls which are joined together at the perimeter thereof, said bladder being separated into plural compartments and each compartment is separated from an adjacent compartment by a vent opening extending through the opposed walls of the bladder whereby air flow through the dryer may pass through said openings.

12. An article for conditioning fabrics within a clothes dryer, comprising:

a bladder defining a chamber adapted to hold a volume of liquid, said bladder comprising a vapor-permeable, liquid proof material;

a closeable fill spout on said bladder and an opening that permits fluidic communication with said chamber;

an absorbent material contained within said bladder for absorbing liquid in said chamber;

a fabric conditioning agent, said agent being micro-encapsulated by a time release coating and being impregnated into said absorbent material;

said fabric conditioning agent being released by said coating after a predetermined time, said conditioning agent being vaporized by the heat of said dryer and having a vapor particle size small enough to permeate the material of said bladder at a predetermined temperature, whereby said article produces a controlled delivery of said conditioning agent during operation of said dryer.

13. An article for conditioning fabrics within a clothes dryer, comprising:

a bladder defining a chamber adapted to hold a volume of liquid, said bladder comprising a vapor-permeable, liquidproof material;

a closeable fill spout on said bladder and an opening that permits fluidic communication with said chamber for adding liquid thereto, a plurality of bodies disposed in said chamber, each body containing a fabric conditioning chemical which is released in vapor form at the operating temperature of said dryer, said liquid being vaporized at the operating temperature of said dryer, whereby said article produces a controlled delivery of the vapors of the liquid and the chemical through said vapor-permeable, liquidproof material during operation of the dryer.

14. The article of claim 13 wherein said bodies comprise said chemical being micro-encapsulated by a time released coating.

* * * * *